United States Patent [19]

Dolf

[11] Patent Number: 5,072,639

[45] Date of Patent: Dec. 17, 1991

[54] METHOD AND APPARATUS FOR REMOVING WASTEPAPER FROM A CONTINUOUS WEB OF PHOTOGRAPHIC PRINTS

[75] Inventor: Richard A. Dolf, Seattle, Wash.

[73] Assignee: Gretag Systems, Inc., Bothell, Wash.

[21] Appl. No.: 710,795

[22] Filed: Jun. 5, 1991

[51] Int. Cl.[5] ..... B26D 5/34

[52] U.S. Cl. ..... 83/42; 83/72; 83/371; 83/209

[58] Field of Search ..... 83/72, 948, 56, 27, 83/105, 106, 371, 365, 367, 209-211, 42, 418, 436; 53/520

[56] References Cited

U.S. PATENT DOCUMENTS

| | | | |
|---|---|---|---|
| 3,465,624 | 9/1969 | Becker | 83/211 |
| 4,098,158 | 7/1978 | Escales et al. | 83/27 |
| 4,161,899 | 7/1979 | Strunc | 83/371 |
| 4,221,144 | 9/1980 | Diesch et al. | 83/27 |
| 4,603,539 | 8/1986 | Müssig et al. | 83/371 |
| 4,821,061 | 4/1989 | Gudmundson et al. | 83/371 |
| 4,943,270 | 7/1990 | Fleckenstein | 83/106 |

*Primary Examiner*—Frank T. Yost
*Assistant Examiner*—Allan M. Schrock
*Attorney, Agent, or Firm*—Christensen, O'Connor, Johnson & Kindness

[57] ABSTRACT

Disclosed is a method and apparatus for removing wastepaper (W) from a continuous web(2) of photographic paper upon which photographic images ($P_1$, $P_2$ . . . ) have been printed. Between each photograph there exists a cut mark (4) that instructs a photographic print cutter (1) where one photograph ends and an adjacent photograph begins. The method comprises advancing the web to a point where a cut mark is expected and sensing the presence or absence of a cut mark. If a cut mark is sensed, the web is advanced to align the cut mark under a cutting knife (8) and the cutting knife is cycled. If a cut mark is not sensed, the web is reversed a predetermined reverse length before the cutting knife is cycled. By reversing the web the predetermined reverse length, it is assured that any length of wastepaper cut from the web will at least be as long as the reverse length. The reverse length is long enough to prevent jamming of the print cutter.

10 Claims, 4 Drawing Sheets

METHOD AND APPARATUS FOR REMOVING WASTEPAPER FROM A CONTINUOUS WEB OF PHOTOGRAPHIC PRINTS

FIELD OF THE INVENTION

The present invention relates to photographic processing equipment in general and, in particular, to a method of removing wastepaper from a continuous web of photographic prints during high-speed photographic cutting operations.

BACKGROUND OF THE INVENTION

In commercial photoprocessing centers, photographic developing machines print customers' orders on long webs of photographic paper. Several of these webs are then spliced together to form a large print roll that is taken to a print cutter where the roll is cut into individual photographs and sorted into envelopes for a customer. Often, along the length of the photographic web that comprises the print roll there exist areas of wastepaper, either where the roll was spliced or in the middle of an order due to a printing error. Wastepaper is defined as any length of paper within a print roll that does not contain print exposures belonging to a customer's order.

In commercial photoprocessing operations, print cutters are capable of cutting and sorting between 20,000 and 30,000 prints per hour. Prior to the present invention, when the operator of a print cutter encountered an area of wastepaper, it was necessary to manually remove it before automatic print cutting could begin again. This manual procedure takes time and even a delay of 30 seconds can significantly impact the number of prints the print cutter can process per hour.

In commercial print cutters such as that disclosed in commonly assigned U.S. Pat. No. 4,943,270, incorporated herein by reference cut marks are placed on the edge of the web, between the individual photographs, to indicate to the print cutter where one photograph ends and the next photograph begins. Generally, such cut marks comprise a small hole, which is sensed by a cut-mark sensor (for example, a phototransistor) that recognizes the presence of a cut mark and signals a cutting knife on the print cutter to cut the web. Also, commercial print cutters usually include a sorter mechanism that stacks the cut photographs before they are placed in an envelope for the customer. Typically, the sorter mechanism includes a drive belt that transports the cut photograph from the cutting knife through the sorter mechanism. Because there is often a gap between the cutting knife and the drive belt, if a piece of wastepaper is cut from the web having a length that is smaller than the length of the gap, it is possible that the piece of wastepaper will jam the cutting machine. Should this occur, the efficiency of the print cutter will obviously be reduced due to the time it takes to unjam the machine. Therefore, it is desirable to have a method for removing wastepaper from a continuous web of photographic paper automatically that will not significantly impact upon print cutter efficiency by ensuring that the length of any waste paper cut from the web will not jam the machine.

SUMMARY OF THE INVENTION

A method and apparatus for removing randomly occurring wastepaper from a continuous web of photographic paper on which photographic images have been printed are disclosed herein. The position of each photographic image on the web is delineated by cut marks that indicate where one photographic image ends and an adjacent photographic image begins. The wastepaper removal method comprises the steps of advancing the web to a point where a cut mark is expected. The web is then sensed for the presence or absence of a cut mark. If a cut mark is sensed, the web is advanced to align the cut mark with a means for cutting the web and the web is cut. If a cut mark is not sensed, it is assumed that the web contains wastepaper at that location. The web is reversed a predetermined length before the cutting means is signaled to out the web. The steps of advancing, sensing, and aligning are repeated until a cut mark is sensed.

In the preferred embodiment, the length of wastepaper removed at one time is maximized by advancing the web a length slightly less than the distance between the cutting means and a pair of pinch rollers included within a sorter mechanism. The predetermined length that the web is reversed is chosen to be greater than or equal to the distance between the cutting means and the sorter mechanism so that any piece of wastepaper cut from the web will be carried from the cutting knife into the sorter mechanism without jamming.

DETAILED DESCRIPTION OF THE PREFERRED EMBODIMENT

Figure 1:
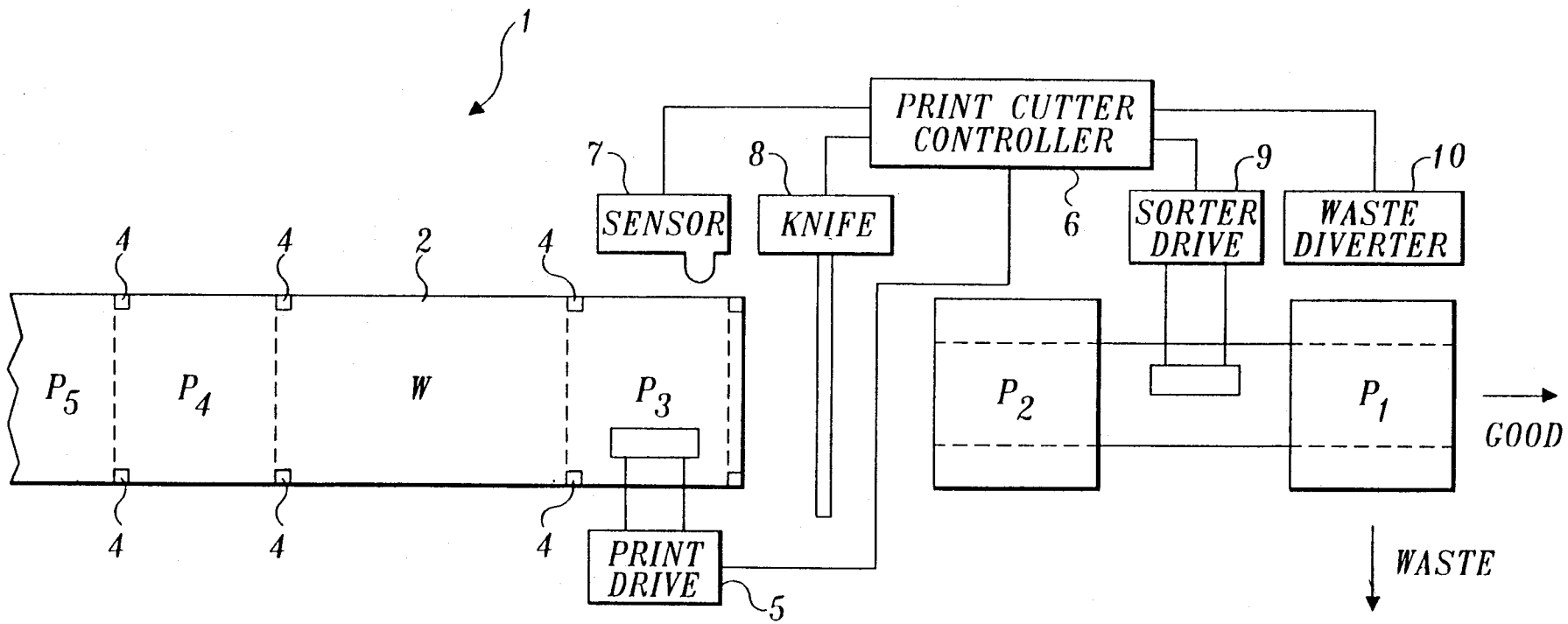
FIG. 1 is a schematic diagram of a print cutter made in accordance with the principles of the present invention.

FIG. 1 is a schematic diagram of a print cutter shown generally at reference numeral 1 made in accordance with the principles of the present invention. A series of photographic prints, $P_1$–$P_5$ is shown printed on a continuous web 2 that extends through the print cutter. Between each photographic print, cut marks 4 are placed to indicate to the print cutter 1 where one print ends and an adjacent print begins. The web 2 is advanced by a print drive 5, which is controlled by a print cutter controller 6. A sensor mechanism 7 detects the presence of the cut marks 4 and signals the print cutter controller to cut a print from the web 2. Print cutter controller 6 operates a knife 8, which cuts an individual photograph from the web. Upon being cut from the web, the photograph is advanced into a sorter mechanism driven by a sorter drive 9. Should an individual photographic print be defective, print cutter controller 6 operates a waste diverter 10, which diverts the individual photographic print from the sorter mechanism into a waste path.

Shown within the web 2 is an area of wastepaper W, on which no photographic prints are printed. The present inventive method serves to remove the wastepaper W automatically and efficiently. As web 2 is advanced through the print cutter 1, sensor 7 detects the presence or absence of a cut mark 4. If a cut mark is missing, print cutter controller 6 controls print drive 5 to advance the web until either a cut mark is sensed by sensor 7 or the web has been advanced a maximum length. The maximum length is the length that web 2 can be advanced without being pulled into the sorter mechanism by sorter drive 9. If the web 2 has been advanced the maximum length and the sensor 7 has not yet detected a cut mark 4, print cutter controller 6 controls print drive 5 to reverse the web a predetermined reverse length. The reverse length is long enough to be handled by the sorter drive without jamming. After reversing the web, print cutter controller 6 instructs the knife 8 to cut the web. The piece of waste is advanced through the sorter mechanism and diverted by waste diverter 10, which is also controlled by the print cutter controller 6. This process continues until sensor 7 detects a cut mark 4.

Figure 2:
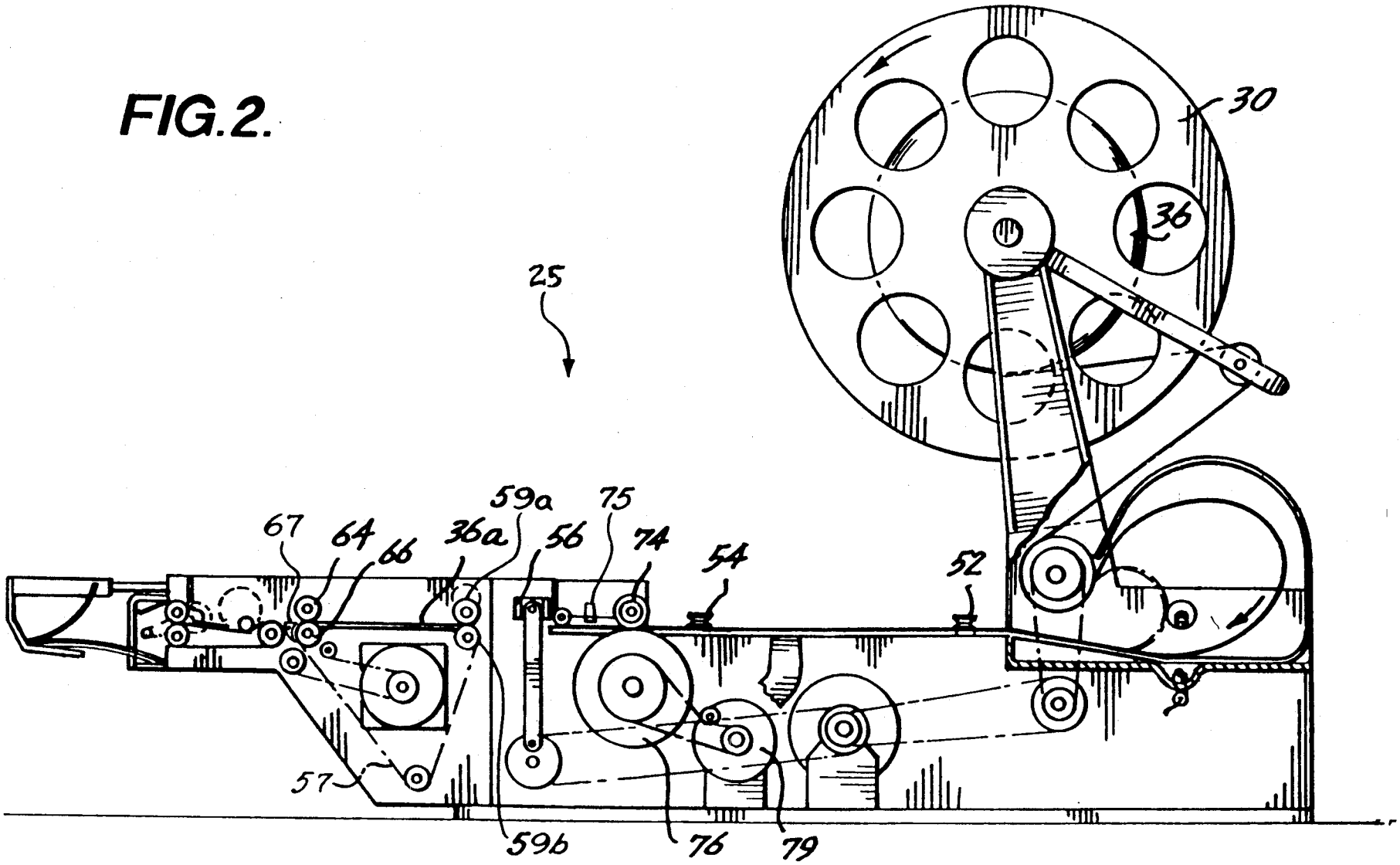
FIG. 2 shows an automatic print cutter in which the present inventive method can be used.

FIG. 2 illustrates an automatic print cutter shown generally at reference numeral 25, which includes a reel 30 containing a continuous web 36 of photographic prints that has been received from a developing and printing machine (not shown). The web 36 is threaded through two pairs of guide rollers 52 and 54 before being passed between a deformable drive roller 74 and a nondeformable drive roller 76. The drive roller 76 is driven by a reversible precision stepper motor 79 that is capable of moving the web 36 in a forward or reverse direction for a precise distance. The operation of the print cutter 25 is preferably controlled by a control means such as a microprocessor (not shown). The microprocessor, along other things, controls the operation of the stepper motor 79 to advance or reverse the web 36 through the print cutter.

Disposed between the drive roller 74 and a cutting knife 56 is a cut-mark sensor 75 that is electrically coupled to the microprocessor. The cut-mark sensor 75 generates a cut mark signal indicative of the presence or absence of a cut mark. Cut marks are generally placed between adjacent prints during the developing and printing process to signal where one print ends and another begins. After the cut-mark sensor 75 detects the presence of a cut mark, the cut mark signal is sent to the microprocessor. The microprocessor then signals the stepper motor 79 to advance the web 36 forward until the cut mark is aligned with the cutting knife 56. When the web is in position, the cutting knife is cycled to sever a print **36*a*** from the remainder of the web.

Downstream of the cutting knife 56 is a sorter mechanism that sorts individual photographs cut from the web 36 into a stack that can be delivered to a customer. A drive belt 57 engages the underside of the cut print **36*a* to transport the print through the sorter mechanism. A pair of driven acceleration rollers 59*a* and 59*b* engage the cut print 36*a* after it has been cut from the web 36 to ensure that the cut print 36*a* makes contact with the drive belt 57. The acceleration roller 59*a* is mounted on a solenoid (not shown), which is controlled by the microprocessor such that it engages the print 36*a* only after the cutting knife 56 has been cycled. A pair of pinch rollers 64 and 66 are disposed on either side of the drive belt 57 and drivingly engage the belt 57 to move the drive belt. Pinch rollers 64 and 66 precede a waste diverter 67 that is also mounted on a solenoid (not shown), which is controlled by the microprocessor. The solenoid on which the waste diverter 67 is mounted can be operated to pivot the waste diverter 67 into the path of the cut print 36*a* if there is something wrong with the print. In that event, the cut print 36*a* is diverted into a wastepaper path before it is transported to a stacker that is part of the sorter. Because the acceleration roller 59*a* does not contact the cut print 36*a* until after the cutting knife 56 is cycled, it is possible for the stepper motor 79 and the nondeformable drive roller 76 to reverse the web 36 out of the sorter mechanism as long as the web has not extended into the nip formed by the pinch rollers 64 and 66, which are nonreversible. Once the web 36 reaches the nip of the pinch rollers 64 and 66**, it will be pulled farther into the sorter mechanism and it will not be possible to reverse it.

Figure 3:
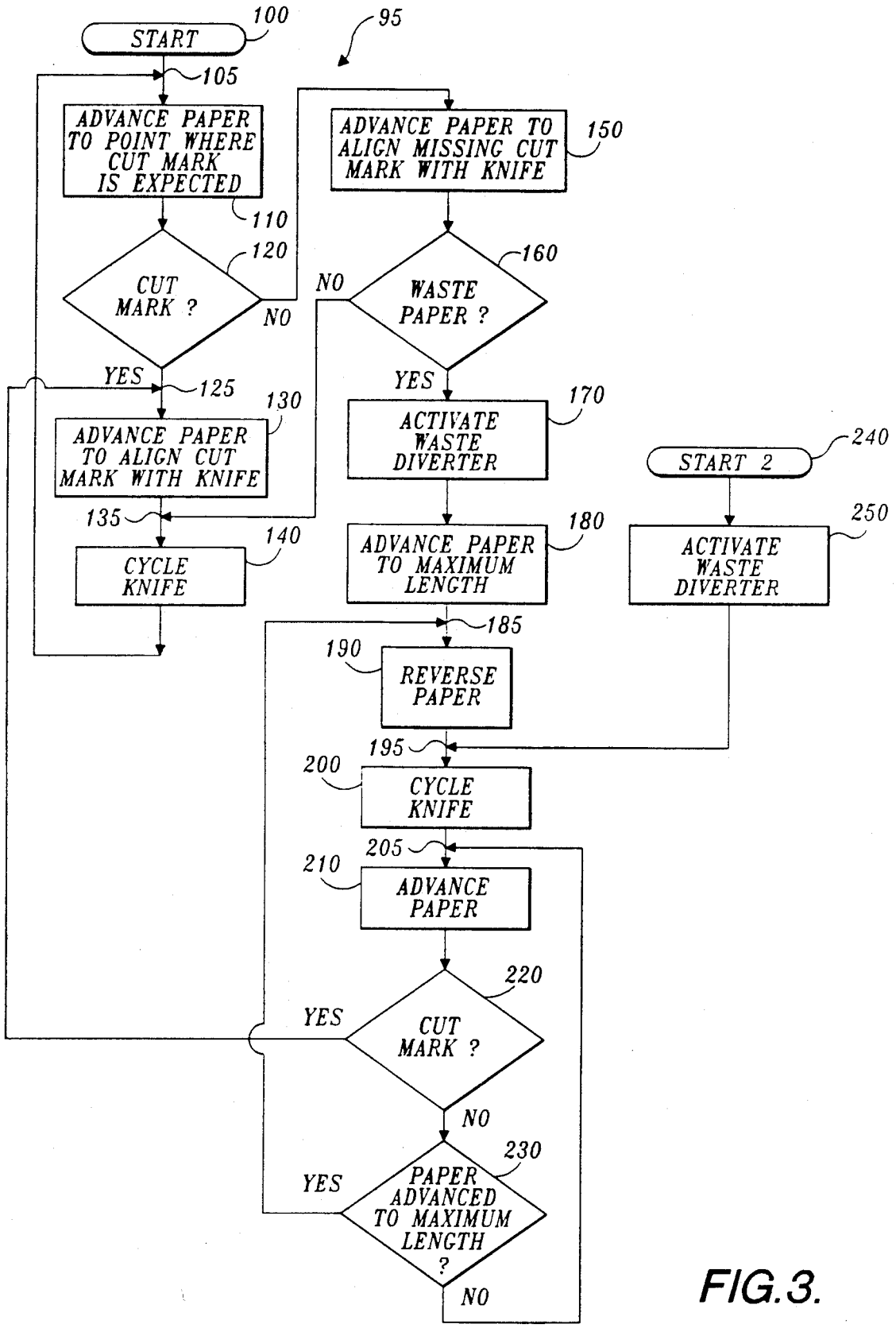
FIG. 3 is a flow chart diagram showing a method for removing wastepaper according to the present invention.

FIG. 3 is a flowchart diagram of the steps of the wastepaper removal method of the present invention. Typically, the microprocessor will be programmed to automatically perform the method steps. The flowchart 95 begins at step 100, where the web is advanced to a point at which a cut mark is expected. Such distance is typically equal to the length of a photographic print, PL. The photographic print cutter 25 can be programmed in advance with the length PL or can determine the length PL by measuring the distance between cut marks as the print cutter is being operated. Once the web reaches the expected cut mark position, a decision must be made as to whether a cut mark is present as expected. At decision block 120, the cut-mark sensor 75 is interrogated to determine whether there is a cut mark at the expected place on the web 36. If a cut mark is found, the web is advanced at step 130 to align the sensed cut mark with the cutting knife 56. Once aligned, the cutting knife 56 is cycled at step 140, thereby severing the cut print **36*a* from the web 36. The above-described steps are then repeated for the next photographic print on the web 36**.

If at the decision block 120 a cut mark is not sensed at the proper place on the web 36, the web is advanced at step 150. In step 150, the web 36 is advanced to align the location of the web 36 at which a cut mark should have been sensed with the cutting knife. At decision block 160, the operator of the photographic print cutter 25 is asked if the paper under the cutting knife 56 is wastepaper. If the answer to decision block 160 is "no", then the cutting knife 56 is cycled at step 140. The answer to decision block 160 would be "no" if, for example, there were two adjacent photographs on the web 36 but, due to an error in the machine that makes the cut marks, there was no cut mark separating the two photographs. In a completely automatic mode of operation, the lack of a cut mark is presumed to mean that the paper at that point is wastepaper. While this may cause some inadvertent print loss at times, it is believed that such occasional loss is statistically acceptable. Such loss would not be acceptable in film handling, but since prints can be remade, it is possible to recover from a loss of prints.

If the answer to decision block 160 is "yes", meaning that the photographic paper under and upstream of the cutting knife 56 is or is assumed to be wastepaper, the waste diverter 67 is activated at step 170 so that it extends into the paper path through the sorter mechanism as shown in FIG. 2. The web is then advanced a predetermined length into the sorter at step 180. The predetermined length is defined as the maximum length the web can extend into the sorter and still be reversed. In the print cutter 25 shown in FIG. 2, the maximum length is less than or equal to the distance from the cutting knife 56 to the nip of pinch rollers 64 and 66. As stated above, if the web 36 is advanced into the nip of the nonreversible pinch rollers 64 and 66, it is not possible to reverse the web out of the sorter mechanism because the pinch rollers operate at a constant rate, which is not dependent on whether the cutting knife 56 was cycled. Prior to reaching step 180, the web 36 extends into the sorter mechanism a length equal to the print length PL. After step 180, the web 36 extends into the sorter mechanism the maximum length, from the cutting knife to the nip of pinch rollers 64 and 66.

After the web is advanced the maximum length, the photographic paper or web 36 is reversed a predetermined reverse length. The reverse length is defined with reference to the print cutter 25 to be greater than or equal to the distance between the nip of the acceleration rollers 59*a* and 59*b* and the cutting knife 56. After the web is reversed, the cutting knife 56 is cycled at step 200, thereby cutting a piece of wastepaper having a length equal to the difference between the maximum length and the reverse length from web 36.

After the first portion of the wastepaper is cut, the web 36 is advanced until a cut mark is sensed as determined at decision block 220 or until the web 36 has been advanced the predetermined maximum length as determined at decision block 230. If a cut mark is sensed before the web 36 has been advanced the maximum length, it means that a print has been found and the web is advanced at step 125 to the point where the cut mark is aligned with the cutting knife. If, at step 210, the web 36 has been advanced for the maximum length without sensing a cut mark, the presence of more wastepaper is presumed, and the web is reversed the reverse length. By reversing the web 36 the reverse length before cycling the cutting knife 56, it is assured that there exists a piece of wastepaper having a length at least as long as the reverse length before the next cut mark. Since a length of wastepaper at least as long as the reverse length is present before the next cut mark, it is assured that a length of wastepaper will not be cut from the web 36 that will jam the print cutter. As stated above, if a length of photographic paper is cut from the web 36 having a length less than the distance from the cutting knife 56 to the nip of the acceleration rollers 59*a* and 59*b*, i.e., less than the reverse length, it is possible that the machine will jam.

A second starting point to the method of the present invention is designated by reference numeral 240 in FIG. 3. The second starting point is provided for removing wastepaper that is present at the beginning of the web 36. By starting at step 240, the method activates the waste diverter 67 immediately and proceeds to cycle the cutting knife 56 at step 200. By cycling the knife in step 200, it is possible to keep track of the end of the web 36, thereby allowing the wastepaper to be removed according to the above-described method.

Figure 4:
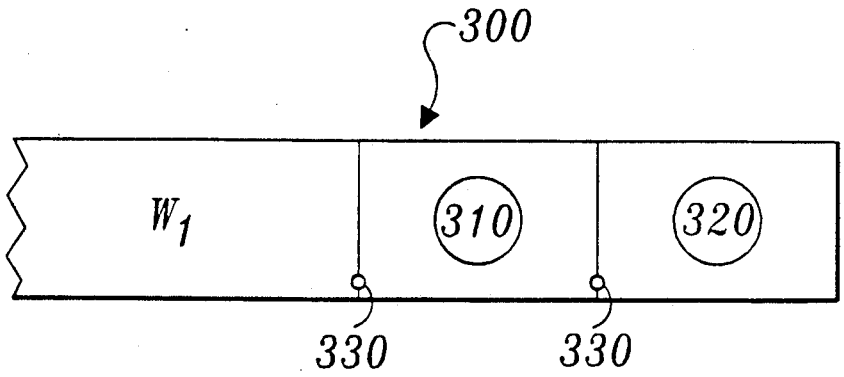
FIG. 4 is a schematic view of a portion of a web of photographic prints including a length of wastepaper that needs to be removed from the web.
Figure 5:
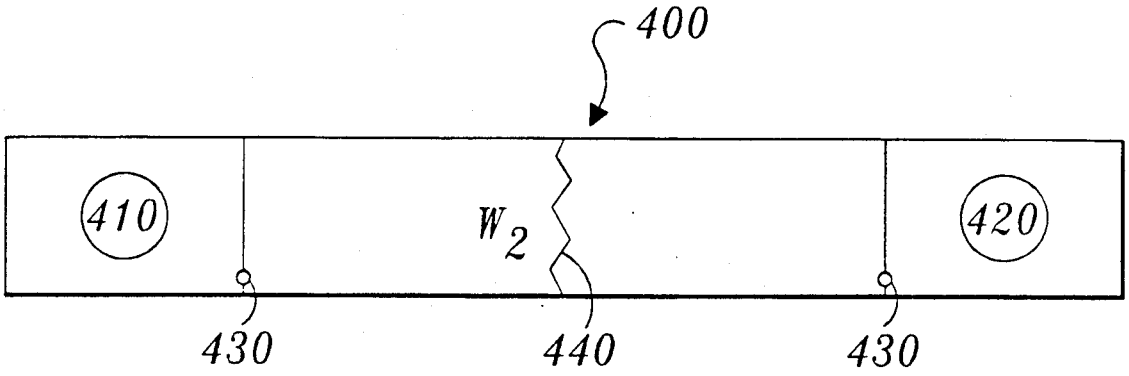
FIG. 5 is a schematic view of a second portion of a web of photographic prints including a second length of wastepaper that needs to be removed from the web.
Figure 6:
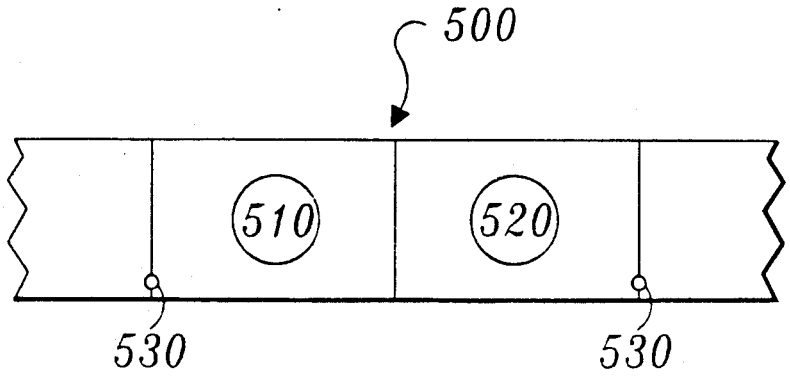
FIG. 6 is a schematic view of a third portion of a web of photographic prints in which a cut mark is missing between two adjacent photographic prints.

FIGS. 4, 5, and 6 show schematically three different situations in which wastepaper must be removed from a web of photographic prints. FIG. 4 shows a web of photographic paper 300 that has a length of wastepaper, $W_1$, preceding two photographs 310 and 320. A cut mark 330 exists between each of the photographs. Because the length of wastepaper $W_1$ is present at the beginning of web 300, the method shown in FIG. 3 will begin at the alternate starting point 240. After initially cycling the cutting knife in step 200, the wastepaper will be removed according to the above-described method following flowchart 95.

In FIG. 5, a web of photographic paper 400 is shown having a length of wastepaper, $W_2$, which is present between two photographs 410 and 420. A cut mark 430 signals the print cutter where to cut the photographs 410 and 420 from the web 400. The length of wastepaper $W_2$ is shown comprising a splice 440, wherein two webs of photographic print paper have been joined together. In accordance with the method shown in the flowchart 95, after cutting the photograph 410 from the web 400, the web 400 is advanced to a point where the next cut mark is expected, i.e., at step 110 shown in FIG. 3. The cutting machine looks for a cut mark, but, because there are no cut marks in the length of wastepaper $W_2$, the web 400 is advanced until the place where a cut mark was expected is aligned under cutting knife 56. A decision must be made as to whether the paper under the cutting knife 56 is wastepaper. The operator can be asked whether the paper under the cutting knife 56 is wastepaper. The operator, seeing that there are no photographs in the length of wastepaper $W_2$, will respond to this question "yes" and the waste diverter will be activated. Alternatively, it can be assumed that the paper is waste due to the absence of a cut mark. In either ease, the length of wastepaper $W_2$ is removed according to the above-described method of flowchart 95 in pieces at least as long as the reverse length, thereby assuring that the print-cutting machine will not be jammed.

FIG. 6 shows a portion of a length of a web 500 in which two photographs 510 and 520 are placed side by side without a cut mark 530 being present. In this situation, web 500 will be advanced according to the flowchart 95 to a point where a cut mark is expected, at which time the print cutter determines if a cut mark exists. Because no cut mark exists between the photographs 510 and 520, the web is advanced to the place on the web where the cut mark should have been under the cutting knife. In one mode of operation, the operator is asked whether the paper under the cutting knife 56 is wastepaper. Because there is no wastepaper separating photographs 510 and 520, the operator responds "no" to this question and, in accordance with the method described, the cutting knife is cycled. In this situation, if the cutter is operated completely automatically and it is assured that the lack of a cut mark is indicative of wastepaper, the prints will be cut and discarded as wastepaper. As stated earlier, in some labs, it may be determined that the occasional destruction of good prints is statistically acceptable to allow faster operation of the print cutter. Since the prints can be remade, there is a recovery possible and the loss of prints would not be permanent.

Although the present invention has been disclosed with respect to its preferred embodiment, those skilled in the art will realize that chances can be made in form and substance without departing from the spirit of the invention. Therefore, it is intended that the scope of the invention be limited only by the following claims.

The embodiments of the invention in which an exclusive property or privilege is claimed are defined as follows:

1. A method of removing wastepaper from a continuous web of photographic paper on which photographic images have been printed, the wastepaper randomly appearing along the web, the method comprising:

placing cut marks on the web to mark the location of the photographic images;

advancing the web to a cutting means;

sensing the presence or absence of a cut mark and signaling the cutting means to cut the web if a cut mark is sensed;

determining if the length advanced by the web since the last cut mark equals a predetermined maximum length that the web can be advanced and, if the length advanced equals the predetermined maximum length, then reversing the web for a predetermined reverse length and signaling the cutting means to cut the web; and repeating the steps of advancing, sensing, and determining until a cut mark is sensed.

2. A method of operating a print cutting machine to remove randomly occurring wastepaper from a continuous web of photographic paper on which photographic images have been printed, wherein the photographic images are separated by cut marks that indicate where one photographic image ends and an adjacent photographic image begins, the method comprising:

advancing the web to a point at which a cut mark is expected;

sensing the presence or absence of a cut mark;

aligning the cut mark with a cutting means and signaling the cutting means to cut the web if a cut mark is sensed;

advancing the web to a predetermined maximum length the web can be advanced;

reversing the web a predetermined reverse length and signaling the cutting means to cut a piece of wastepaper from the web; and repeating the steps of advancing, sensing, aligning, and reversing until a cut mark is sensed.

3. The method of claim 2, wherein the steps of advancing and sensing are repeated until a cut mark is sensed or until the web has been advanced a length substantially equal to the maximum length of wastepaper that can be cut from the web by the cutting machine if a cut mark was not sensed at a location on the web where it was expected.

4. The method of claim 2, further comprising the step of:

activating a waste diverter if a cut mark was not sensed at a location on the web where it was expected.

5. Apparatus for removing wastepaper from a continuous web of photographic paper on which photographic images have been printed, wherein between each of the photographic images there exists a cut mark, the apparatus comprising:

reversible means for driving the web through the apparatus;

means for sensing the presence or absence of a cut mark and for generating a cut mark signal indicative of the presence or absence of a cut mark;

cutting means for cutting an individual photographic print from the web;

controller means for controlling the operation of the reversible means for driving the web and the cutting means, the controller means being connected to receive the cut mark signal from the means, for sensing the presence or absence of a cut mark; and said controller means operating the reversible means for driving the web so as to advance the web a predetermined maximum length or until the cut mark signal indicates the presence of a cut mark, if the cut mark signal indicates the presence of a cut mark, the controller means operating the cutting means to cut the web at the cut mark, if the web has been advanced the maximum length without the cut mark signal indicating the presence of a cut mark, the controller means operating the reversible means for driving the web such that the web is reversed a predetermined reverse length before operating the cutting means to cut a piece of wastepaper from the web.

6. The apparatus as in claim 5, further comprising:

means for sorting the photographic images after they have been cut from the web, wherein the means for sorting includes a pair of pinch rollers that transport a cut print through the means for sorting and wherein the maximum length that the web is advanced is less than or equal to the distance between the cutting means and the pair of pinch rollers.

7. The apparatus as in claim 6, wherein the means for sorting further includes a print drive means to advance a photographic image through the sorter wherein the reverse length that the web is reversed is greater than or equal to the distance between the cutting means and the print drive means.

8. A method of operating a photographic print cutter to remove a length of wastepaper from a continuous web of photographic paper containing a plurality of photographic prints, wherein the photographic cutting machine is of the type having a cut-mark sensor, a cutting knife, and a sorter mechanism and wherein each adjacent photographic print is separated by a cut mark that indicates where one photographic print ends and an adjacent photographic print begins, the method comprising:

(a) advancing the web until the cut-mark sensor senses a cut mark or until the web has been advanced a predetermined maximum length equal to the maximum length of wastepaper that can be removed by the cutting machine;

(b) cutting the web if a cut mark is sensed;

(c) reversing the web for a predetermined reverse length if the web has been advanced the maximum length and the cut-mark sensor has not sensed a cut mark and after the web has been reversed the reverse length, cutting the web; and (d) repeating steps (a), (b), and (c) until the cut-mark sensor senses a cut mark.

9. The method of claim 8, wherein the sorter mechanism further comprises a pair of pinch rollers that move a print through the sorter mechanism and wherein the maximum length that the web is advanced is less than or equal to the distance between the cutting knife and the pair of pinch rollers.

10. The method of claim 8, wherein the cutting knife and the sorter mechanism are spaced from one another, and the reverse length that the web is reversed is greater than or equal to the distance between the cutting knife and the sorter mechanism.

* * * * *